US010731352B2

(12) United States Patent
Hendricks, Jr.

(10) Patent No.: US 10,731,352 B2
(45) Date of Patent: Aug. 4, 2020

(54) ROLLABLE RIDGE VENT

(71) Applicant: Owens Corning Intellectual Capital, LLC, Toledo, OH (US)

(72) Inventor: Robert K. Hendricks, Jr., Youngstown, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 15/650,183

(22) Filed: Jul. 14, 2017

(65) Prior Publication Data

US 2018/0016794 A1 Jan. 18, 2018

Related U.S. Application Data

(60) Provisional application No. 62/362,682, filed on Jul. 15, 2016.

(51) Int. Cl.
*E04D 13/17* (2006.01)
*F24F 7/02* (2006.01)

(52) U.S. Cl.
CPC ..... *E04D 13/176* (2013.01); *F24F 7/02* (2013.01)

(58) Field of Classification Search
USPC ..... 454/365
See application file for complete search history.

(56) References Cited

U.S. PATENT DOCUMENTS 2,447,472 A 8/1948 Donley
2,777,381 A 1/1957 Noyes et al.
4,325,290 A 4/1982 Wolfert
4,554,862 A 11/1985 Wolfert
4,776,262 A 10/1988 Curran
4,803,813 A 2/1989 Fiterman
4,807,409 A 2/1989 Sells
4,843,953 A 7/1989 Sells
4,957,037 A * 9/1990 Tubbesing ..... E04D 13/174 454/366
5,054,254 A 10/1991 Sells
5,094,041 A 3/1992 Kasner et al.
5,122,095 A 6/1992 Wolfert
5,167,579 A 12/1992 Rotter
5,238,450 A 8/1993 Rotter
5,288,269 A 2/1994 Hansen
(Continued)

*Primary Examiner* — Edelmira Bosques
*Assistant Examiner* — Frances F. Hamilton
(74) *Attorney, Agent, or Firm* — Calfee, Halter & Griswold LLP

(57) ABSTRACT

A rollable ridge vent for covering an open ridge of a roof and for allowing a flow of air to exit from the open ridge through the ridge vent includes a top panel having a center portion, a left side portion, and a right side portion, in which the top panel includes a plurality of louvers for allowing a flow of air to exit the ridge vent. In addition, the rollable ridge vent includes a spaced apart series of inner walls and a spaced apart series of outer walls extending downward from the left side portion of the top panel. The spaced apart series of inner walls and the spaced apart series of outer walls of the left side portion are staggered. The rollable ridge vent also includes a spaced apart series of inner walls and a spaced apart series of outer walls extending downward from the right side portion of the top panel. The spaced apart series of inner walls and the spaced apart series of outer walls of the right side portion are staggered.

9 Claims, 16 Drawing Sheets

(56) References Cited

U.S. PATENT DOCUMENTS 5,304,095 A 4/1994 Morris
5,326,318 A 7/1994 Rotter
5,328,406 A 7/1994 Morris, Jr. et al.
5,331,783 A 7/1994 Kasner et al.
5,352,154 A 10/1994 Rotter et al.
5,425,672 A 6/1995 Rotter
5,427,571 A 6/1995 Sells
5,439,417 A 8/1995 Sells
5,542,882 A 8/1996 Sells
5,560,157 A 10/1996 Rotter
5,561,953 A 10/1996 Rotter
5,596,847 A 1/1997 Stephenson
5,603,657 A 2/1997 Sells
5,630,752 A 5/1997 Gubash
5,651,734 A 7/1997 Morris
5,673,521 A 10/1997 Coulton et al.
5,676,597 A 10/1997 Bettoli et al.
5,704,834 A 1/1998 Sells
5,772,502 A * 6/1998 Smith ..... E04D 13/174 454/365
5,830,059 A 11/1998 Sells
5,832,677 A 11/1998 Kurttila
5,921,863 A 7/1999 Sells
5,934,995 A 8/1999 Morris et al.
5,946,868 A 9/1999 Morris
5,947,817 A 9/1999 Morris et al.
5,996,289 A 12/1999 Allaster
6,015,343 A 1/2000 Castillo et al.
6,039,646 A 3/2000 Sells
6,128,869 A 10/2000 Brotherton et al.
6,145,225 A 11/2000 Allaster
6,149,517 A 11/2000 Hansen
6,212,833 B1 4/2001 Henderson
6,213,868 B1 4/2001 Sells
6,227,963 B1 * 5/2001 Headrick ..... E04D 13/174 454/365
6,233,887 B1 * 5/2001 Smith ..... E04D 13/176 52/198
6,260,315 B1 * 7/2001 Smith ..... E04D 13/176 454/365
6,267,668 B1 7/2001 Morris
RE37,388 E 9/2001 Kasner et al.
6,286,273 B1 9/2001 Villeia et al.
6,299,528 B1 10/2001 Hansen
6,302,785 B1 10/2001 McKinney et al.
6,357,193 B1 3/2002 Morris
6,371,847 B2 * 4/2002 Headrick ..... E04D 13/174 454/365
6,418,692 B1 7/2002 Freshwater et al.
6,447,392 B1 9/2002 Henderson
6,450,882 B1 9/2002 Morris et al.
6,458,029 B2 10/2002 Morris
D465,839 S 11/2002 Sells
6,482,084 B2 * 11/2002 Hansen ..... E04D 13/174 454/365
6,487,826 B1 12/2002 McCorsley et al.
6,530,189 B2 3/2003 Freshwater et al.
6,537,147 B2 3/2003 Smith
6,558,251 B2 5/2003 Sells
6,565,431 B1 5/2003 Villela
6,578,325 B2 6/2003 Henderson
6,589,113 B2 7/2003 Sells
6,595,849 B2 7/2003 Miller
6,598,356 B1 7/2003 Sells
6,599,184 B2 7/2003 Morris
6,623,354 B2 9/2003 Morris et al.
6,684,581 B2 * 2/2004 Robinson ..... E04D 13/176 454/365
6,793,574 B1 9/2004 Robinson
6,881,144 B2 * 4/2005 Hansen ..... E04D 13/176 454/365
6,913,530 B2 7/2005 Morris et al.
D511,847 S 11/2005 Ciepliski
D511,848 S 11/2005 Ciepliski
6,991,535 B2 * 1/2006 Ciepliski ..... E04D 13/176 454/365
7,024,828 B2 * 4/2006 Headrick ..... E04D 13/176 52/198
7,044,852 B2 5/2006 Horton
7,143,557 B1 12/2006 Ayers, Jr.
7,165,363 B2 * 1/2007 Headrick, II ..... E04D 13/176 454/365
7,302,776 B2 12/2007 Duncan et al.
7,384,331 B2 6/2008 Coulton
D574,947 S 8/2008 Grisham et al.
7,485,034 B2 2/2009 Sells
7,520,098 B1 4/2009 Martinique et al.
7,537,518 B2 * 5/2009 Villela ..... F24F 7/02 454/365
7,540,803 B2 6/2009 Sells
7,562,498 B2 7/2009 Galeazzo et al.
7,591,109 B2 9/2009 Rotter
7,594,362 B2 9/2009 Sigmund et al.
D602,579 S 10/2009 Stone
7,604,536 B2 10/2009 Coulton et al.
7,644,545 B2 1/2010 Mankell et al.
7,662,037 B2 * 2/2010 Polston ..... E04D 13/174 454/365
7,716,894 B2 5/2010 Jolitz
D618,331 S 6/2010 Stone
7,765,750 B2 8/2010 Duncan
7,766,735 B2 * 8/2010 Ciepliski ..... F24F 7/02 454/365
7,814,715 B2 * 10/2010 Coulton ..... F24F 7/02 454/364
7,823,343 B1 11/2010 Inzeo
7,856,764 B2 12/2010 Korteum et al.
8,028,475 B2 10/2011 Sigmund et al.
8,061,102 B2 11/2011 Turek et al.
8,069,621 B2 * 12/2011 Mantyla ..... E04D 13/174 454/250
D654,161 S 2/2012 Holland et al.
8,136,322 B2 3/2012 Shadwell et al.
8,205,398 B2 6/2012 Chich et al.
8,211,350 B2 7/2012 Carlson et al.
8,292,707 B2 10/2012 Grisham et al.
8,322,089 B2 * 12/2012 Railkar ..... E04D 13/174 52/198
8,528,269 B2 9/2013 Chieh et al.
8,528,270 B2 9/2013 Chieh et al.
RE44,832 E * 4/2014 Headrick ..... F24F 7/02 454/365
8,740,678 B2 6/2014 Railkar et al.
8,790,167 B2 7/2014 Holland et al.
9,022,845 B2 5/2015 Henderson
9,175,480 B1 * 11/2015 Polston ..... E04D 13/174
9,353,962 B2 5/2016 Lowe et al.
2001/0019941 A1 * 9/2001 Headrick ..... E04D 13/174 454/365
2004/0198216 A1 10/2004 Morris et al.
2004/0237428 A1 * 12/2004 Headrick ..... E04D 13/176 52/198
2005/0136830 A1 6/2005 Morris et al.
2006/0116069 A1 6/2006 Urbanski et al.
2006/0240762 A1 10/2006 Railkar et al.
2007/0026789 A1 2/2007 Villela
2007/0117505 A1 5/2007 Wey et al.
2007/0234650 A1 10/2007 Coulton et al.
2008/0125028 A1 5/2008 Morris et al.
2008/0182507 A1 7/2008 Morris et al.
2008/0287054 A1 * 11/2008 Carlson ..... E04D 13/174 454/365
2008/0299892 A1 12/2008 Robinson
2009/0233541 A1 * 9/2009 Holland ..... B29C 45/0003 454/365
2010/0112932 A1 * 5/2010 Grubka ..... E04D 13/174 454/365
2011/0030287 A1 2/2011 Moore
2011/0154743 A1 6/2011 Railkar
2011/0195655 A1 * 8/2011 Holland ..... F24F 7/02 454/365
2011/0201266 A1 8/2011 Henderson

(56) References Cited

U.S. PATENT DOCUMENTS

| | | | | |
|---|---|---|---|---|
| 2011/0265407 | A1 | 11/2011 | Bryson | |
| 2014/0308891 | A1* | 10/2014 | Holland | E04D 13/174 454/365 |
| 2016/0201332 | A1* | 7/2016 | Fiser | E04D 13/174 454/365 |

* cited by examiner

ROLLABLE RIDGE VENT

RELATED APPLICATIONS

This application is related to and claims domestic priority benefits from U.S. Provisional Patent Application Ser. No. 62/362,682 entitled "Rollable Ridge Vent" filed Jul. 15, 2016, the entire contents of which are expressly incorporated herein by reference in its entirety.

BACKGROUND

Buildings, such as for example residential buildings, are typically covered by sloping roof planes. The interior portion of the building located directly below the sloping roof planes forms a space called an attic. If unventilated or under-ventilated, condensation can form on the interior surfaces within the attic. The condensation can cause damage to various building components within the attic, such as for example insulation, as well as potentially causing damage to the building structure of the attic. In addition, unventilated or under-ventilated spaces are known to cause ice blockages ("ice dams") on the sloping roof planes. The ice blockages can cause water to damage portions of the various building components forming the roof and the attic.

Accordingly it is known to ventilate attics, thereby helping to prevent the formation of condensation. Some buildings are formed with structures and mechanisms that facilitate attic ventilation. The structures and mechanisms can operate in active or passive manners. An example of a structure configured to actively facilitate attic ventilation is an attic fan. An attic fan can be positioned at one end of the attic, typically adjacent an attic gable vent, or positioned adjacent a roof vent. The attic fan is configured to exhaust air within the attic and replace the exhausted air with fresh air.

Examples of structures configured to passively facilitate attic ventilation include ridge vents and soffit vents. Ridge vents are structures positioned at the roof ridge, which is the intersection of the uppermost sloping roof planes. In some cases, the ridge vents are designed to cooperate with the soffit vents, positioned near the gutters, to allow a flow of air to enter the soffit vents, travel through a space between adjoining roof rafters to the attic, travel through the attic and exit through the ridge vents.

US Published Patent Application Pub. No. 20100112932, which is incorporated herein by reference in its entirety, discloses a ridge vents configured to cover an open ridge of a roof and allow a flow of air to exit from the open ridge through the ridge vents. Prior art FIGS. 1 and 2 are from US Published Patent Application Pub. No. 20100112932.

FIGS. 1 and 2 illustrate a typical roof construction. The structural members of the roof may comprise a plurality of support members 18, such as the illustrated rafters or trusses (not shown). The upper ends of the illustrated rafters meet at, and are attached to, a ridge beam 22, Sub-roofing or sheathing 24, typically comprising plywood panels, is secured to the support members 18. Conventional shingles 26 may be nailed to the sheathing 24 to finish the sloping portions of the roof in accordance with accepted construction practice. Conventional cap shingles 30 may then be employed in over lapping fashion to cover the peak of the roof, above the ridge beam 22. A ridge vent 10 is interposed between the cap shingles 30 and the underlying, compositely formed portions of the roof.

A slot 12 is provided along the length of the peak of the roof to provide a passageway for venting air from the underlying attic area. The ends of the slot are spaced from the opposite ends of peak. The ridge vents include a center portion 32 having a length and a plurality of grooves. Left and right portions 34, 36 are connected to the center portion. The center portion is configured to flex along its length, thereby forming a ridge vent angle β between the left and right portions. The formed ridge vent angle β is configured to correspond with a slope between roof decks defining the open ridge. The ridge vent 10 overlies the slot 12, thus providing a primary barrier for preventing entry of water, and other foreign matter, into the attic area.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

SUMMARY

An exemplary embodiment of a rollable ridge vent for covering an open ridge of a roof and for allowing a flow of air to exit from the open ridge through the ridge vent includes a top panel having a center portion, a left side portion, and a right side portion, in which the top panel includes a plurality of louvers for allowing a flow of air to exit the ridge vent. In addition, the rollable ridge vent includes a spaced apart series of inner walls and a spaced apart series of outer walls extending downward from the left side portion of the top panel. The spaced apart series of inner walls and the spaced apart series of outer walls of the left side portion are staggered. The rollable ridge vent also includes a spaced apart series of inner walls and a spaced apart series of outer walls extending downward from the right side portion of the top panel. The spaced apart series of inner walls and the spaced apart series of outer walls of the right side portion are staggered.

Another exemplary embodiment of a rollable ridge vent for covering an open ridge of a roof and for allowing a flow of air to exit the open ridge through the ridge vent includes a top panel, a first end wall, a second end wall, upward and downward extending insertion prongs, upward and downward extending receiver prongs, and a plurality of louvers. The first end wall and the second end wall extend downward from the top panel. The upward and downward extending insertion prongs extend from the first end wall, and the upward and downward extending receiver prongs extend from the second end wall. The plurality of louvers allows a flow of air to exit the ridge vent.

An exemplary embodiment of a rollable ridge vent assembly for covering an open ridge of a roof and for allowing a flow of air to exit from the open ridge through the ridge vent assembly includes a first ridge vent member and a second ridge vent member. The first ridge vent member includes a top panel, a first end wall, a second end wall, upward and downward insertion prongs, and a plurality of louvers. The first end wall and the second end wall of the first ridge vent member extend downward from the top panel, and the upward and downward extending insertion prongs extend from the first end wall. The plurality of louvers of the first ridge vent member allow a flow of air to exit the ridge vent assembly. The second ridge vent member includes a top panel, a first end wall, a second end wall, upward and downward receiver prongs, and a plurality of louvers. The first end wall and the second end wall of the second ridge vent member extend downward from the top panel, and the upward and downward extending receiver prongs extend from the first end wall. The plurality of louvers of the second ridge vent member allow a flow of air to exit the ridge vent assembly. The insertion prongs of the first ridge vent member are interlockingly meshed with the receiver prongs of the second ridge vent member to connect the first ridge vent member to the second ridge vent member.

Another exemplary embodiment of a rollable ridge vent for covering an open ridge of a roof and for allowing a flow of air to exit from the open ridge through the ridge vent includes a top panel having a center portion, a left side portion, and a right side portion, in which the top panel includes a plurality of louvers for allowing a flow of air to exit the ridge vent. In addition, the rollable ridge vent includes a spaced apart series of inner walls and a spaced apart series of outer walls extending downward from the left side portion of the top panel. The spaced apart series of inner walls and the spaced apart series of outer walls of the left side portion are staggered. The rollable ridge vent also includes a spaced apart series of inner walls and a spaced apart series of outer walls extending downward from the right side portion of the top panel. The spaced apart series of inner walls and the spaced apart series of outer walls of the right side portion are staggered. Additionally, the rollable ridge vent includes a first end wall, a second end wall, upward and downward extending insertion prongs, and upward and downward extending receiver prongs. The first end wall extends downward from the top panel, and the upward and downward extending insertion prongs extend from the first end wall. The second end wall extends downward from the top panel, and the upward and downward extending receiver prongs extend from the second end wall.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, a ridge vent is provided. It will be understood the term "ridge" refers to the intersection of the uppermost sloping roof planes. The term "roof plane" is defined to mean the plane defined by a roof surface. The term "slope" is defined to mean the degree of roof incline expressed as a ratio of the rise in inches to the run of roof. The term "sheathing", as used herein, is defined to mean exterior grade boards used as a roof deck material. The term "roof deck", as used herein is defined to mean the surface installed over the supporting framing members to which the roofing is applied. The term "louvers" as used herein, is defined to mean a quantity of openings positioned in the ridge vent and used for ventilation purposes.

Figure 1:
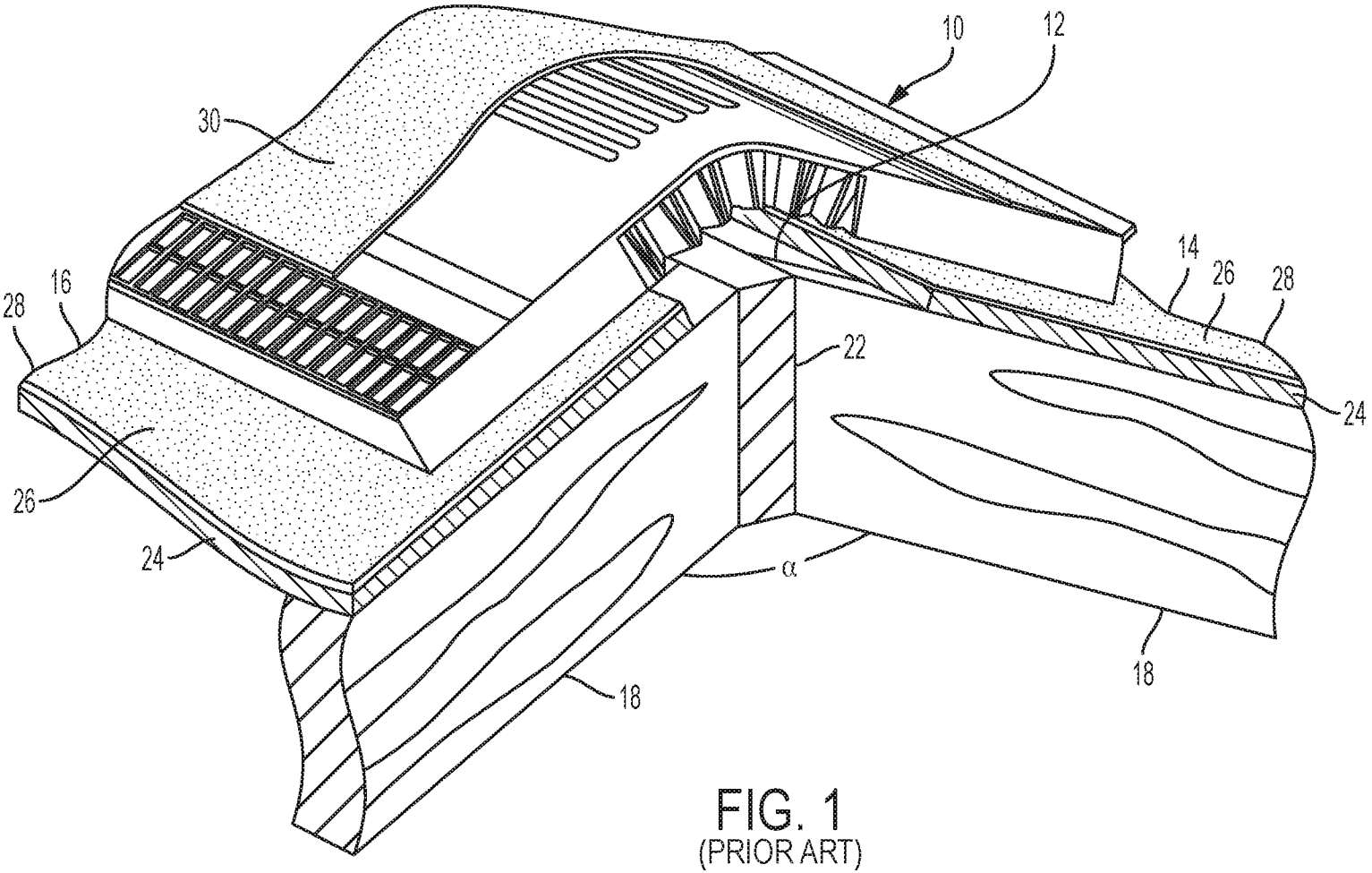
FIG. 1 (PRIOR ART)
FIG. 1 is a partial perspective view of a prior art ridge vent shown installed on a portion of a roof.
Figure 1A:
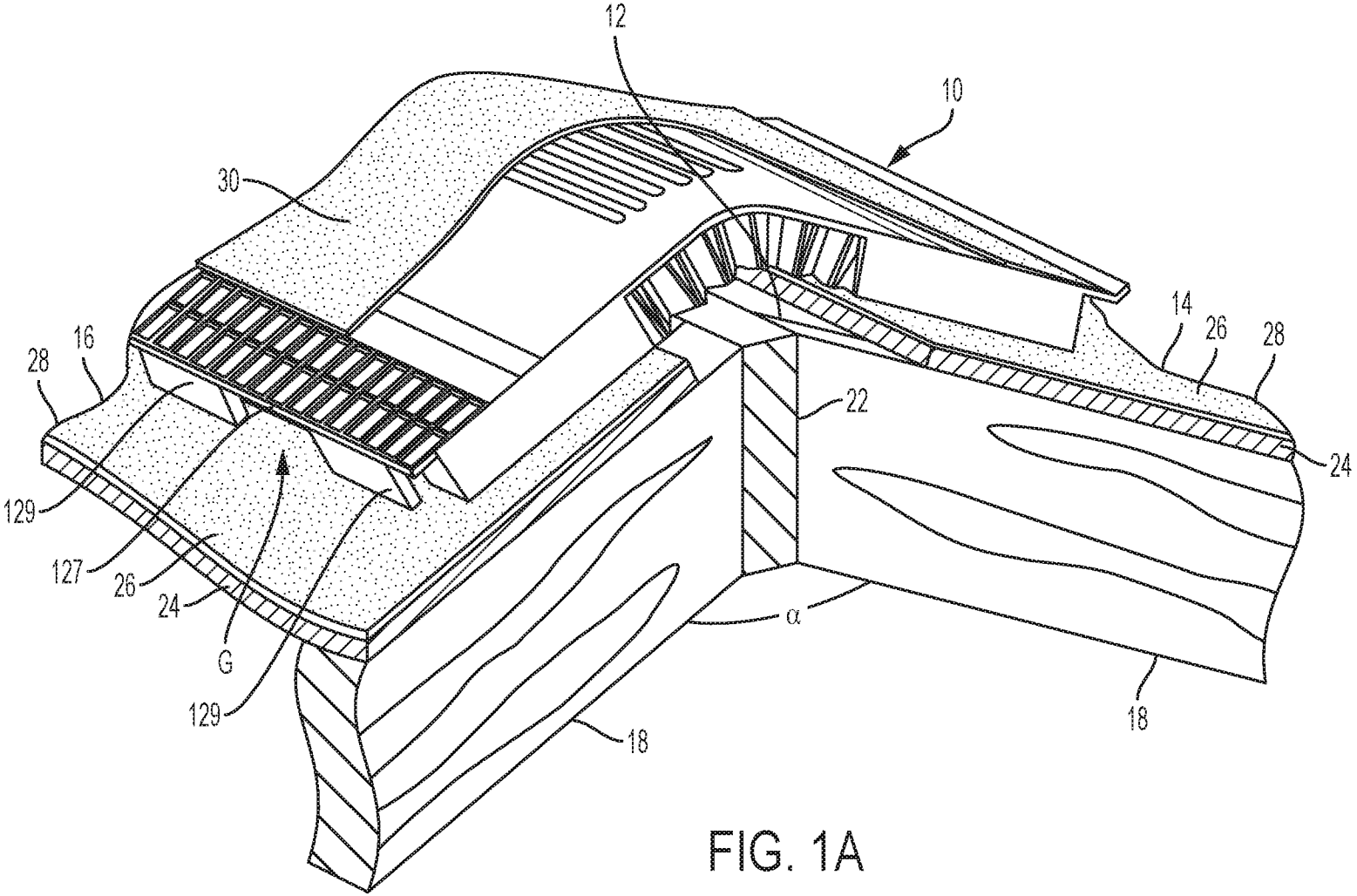
FIG. 1A is a partial perspective view of an exemplary embodiment of a rollable ridge vent shown installed on a portion of a roof in accordance with embodiments of this invention.
Figure 2:
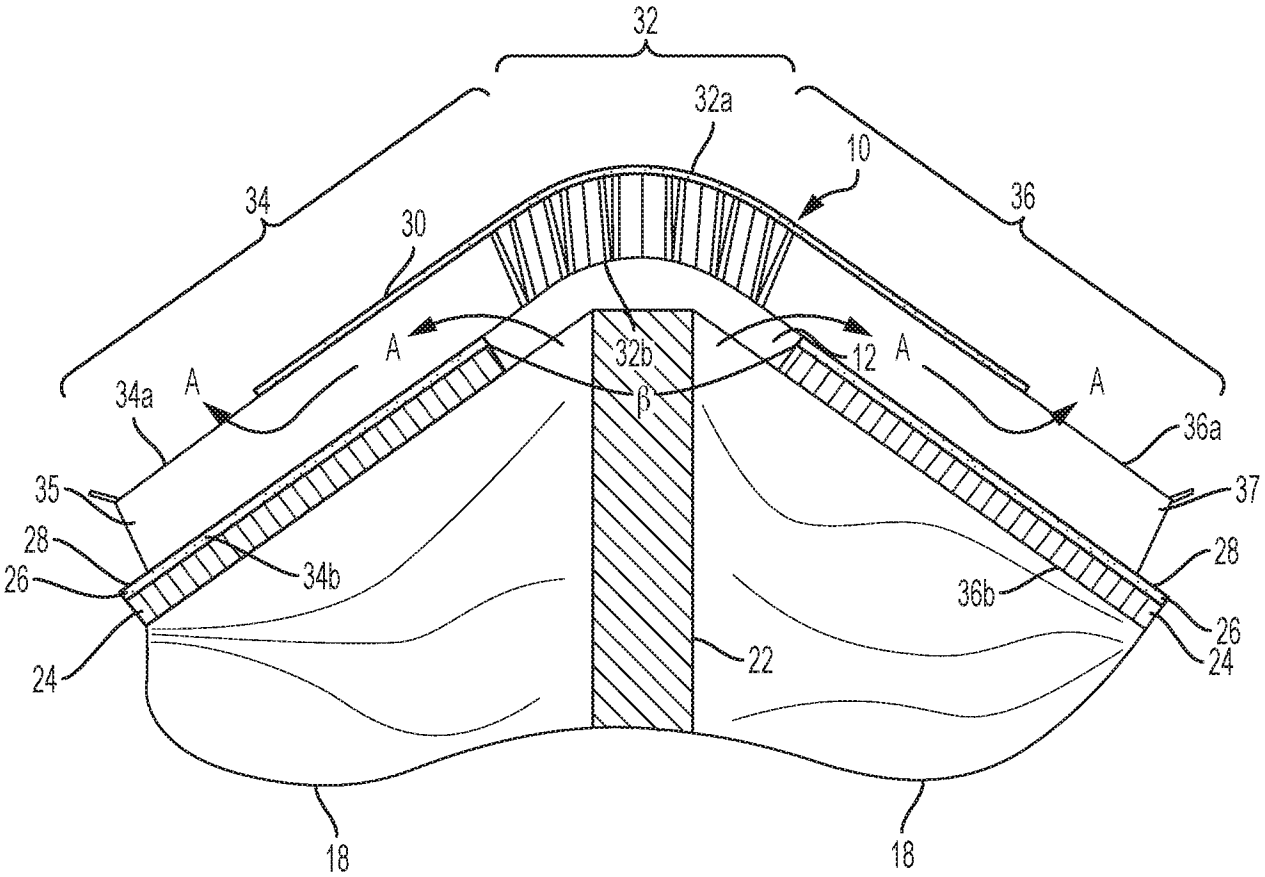
FIG. 2 (PRIOR ART)
FIG. 2 is a front elevational view of the prior art ridge vent of FIG. 1 shown installed on a portion of a roof.
Figure 2A:
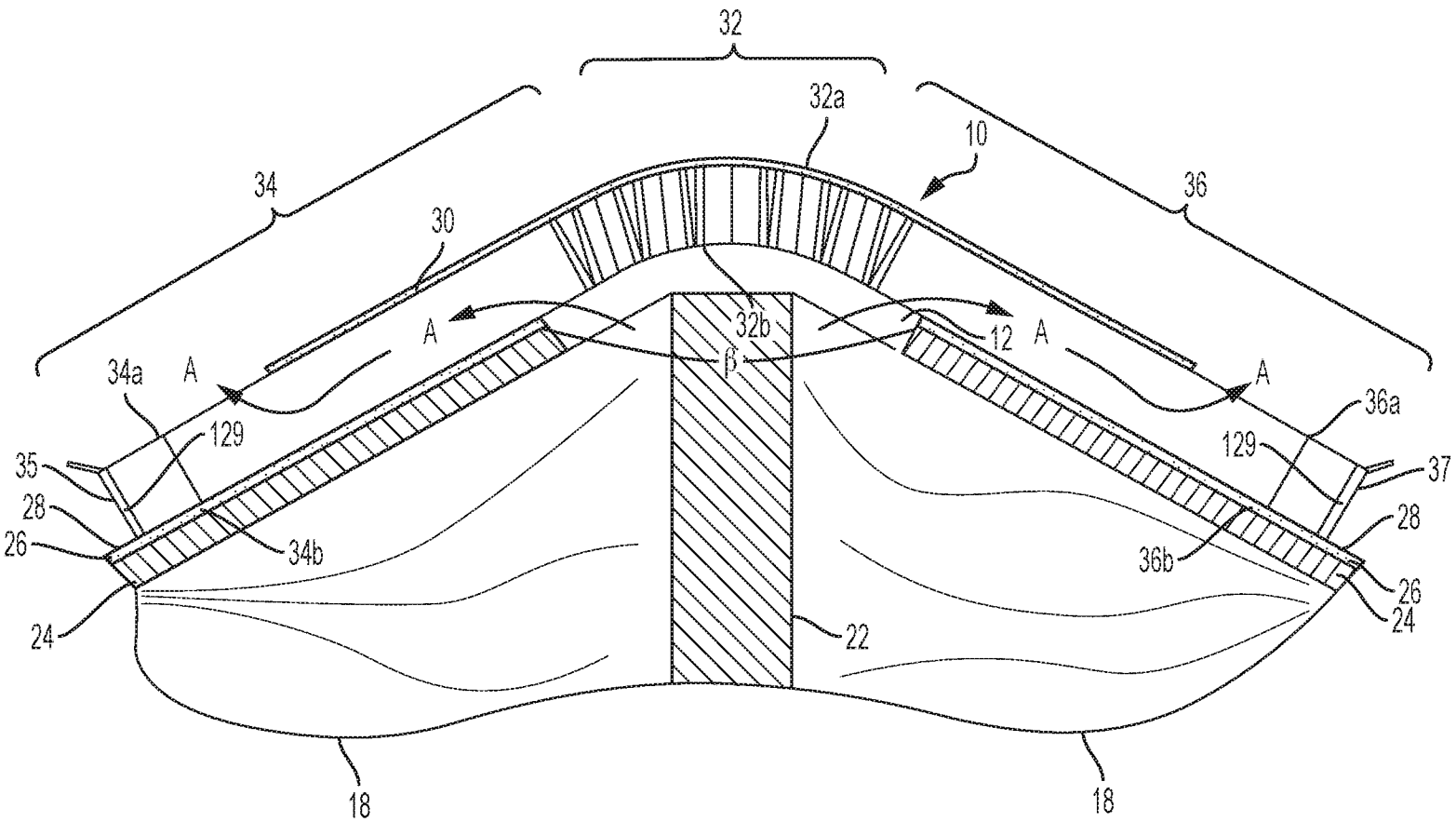
FIG. 2A is a front elevational view of the rollable ridge vent of FIG. 1A shown installed on a portion of a roof.

Referring now to FIGS. 1A and 2A, an exemplary embodiment of a rollable ridge vent 10 is shown. Generally, the ridge vent 10 is configured to span a ridge opening 12 formed between opposing first and second roof planes, 14 and 16, and allow a flow of air to travel through an attic and exit through the ridge vent 10.

Each of the first and second roof planes, 14 and 16, is formed by a series of generally parallel, spaced apart support members 18, such as truss chords or the illustrated rafters (for purposes of clarity, only one support member 18 is shown for each of the roof planes, 14 and 16). In the illustrated embodiment, the rafters 18 are connected at one end to a ridge board 22 and at the other end to a wall (not shown). In other embodiments, the ends of the support members 18 can be connected to other desired components or structures, such as a bottom member of a truss. In the illustrated embodiment, the rafters 18 and the ridge board 22 are made from framing lumber, having sizes including, but not limited to 2 inches thick by 10 inches wide. Alternatively, the rafters 18 and the ridge board 22 can be made from other desired materials and have other desired sizes.

The first and second roof planes, 14 and 16 form a slope angle α. In the illustrated embodiment, the slope angle α is approximately 120 degrees. Alternatively, the slope angle α can be more or less than approximately 120 degrees.

As shown in FIGS. 1A and 2A, the support members 18 are covered by sheathing 24. The sheathing 24 is configured to form an upper surface 28 of the roof planes, 14 and 16. In the illustrated embodiment, the sheathing 24 is made of a wood-based material, including, but not limited to oriented strand board or plywood. In other embodiments, the sheathing 24 can be other desired materials.

The upper surface 28 of the roof planes, 14 and 16, supports a plurality of shingles 26. The shingles 26 are attached to the upper surface 28 of the sheathing 24 by using any desired fasteners, including, but not limited to roofing nails (not shown). It should be understood that the shingles 26 can be any desired roofing material.

While the ridge opening 12 shown in FIGS. 1A and 2A is formed by the structure of the rafters 18, ridge board 22 and roof planes, 14 and 16, it should be understood the ridge opening 12 can be formed by other structures or combinations of structures. For example, the ridge opening 12 can be formed by spacing or cutting away the sheathing 24 a distance from apexes of trusses.

As shown in FIG. 2A, the ridge vent 10 includes a center portion 32, a left portion 34 and a right portion 36. The center portion 32, left portion 34 and the right portion 36 each have a top surface, 32*a*, 34*a* and 36*a*, respectively and a bottom surface 32*b*, 34*b* and 36*b*, respectively. The left portion 34 has a left edge 35 and the right portion 36 has a right edge 37.

Referring again to FIG. 2A, the center portion 32 of the ridge vent 10 is configured to flex, thereby allowing the left and right portions, 34 and 36, to form a ridge vent angle β. The ridge vent angle β is configured to allow the bottom surfaces, 34*b* and 36*b*, of the left and right portions, 34 and 36, to seat against the first and second roof planes, 14 and 16. In the illustrated embodiment, the ridge vent angle β is the same angle as the slope angle α formed by the opposing support members 18. In other embodiments, the ridge vent angle β can be other angles suitable to allow the bottom surfaces, 34*b* and 36*b*, of the left and right portions, 34 and 36, to seat against the first and second roof planes, 14 and 16. As will be explained later in more detail, the left and right portions, 34 and 36, of the ridge vent 10 are fastened to the roof planes, 14 and 16, and portions of the ridge vent 10 are covered by a row of vent shingles 30.

As shown in FIG. 2A, the ridge vent 10 spans the ridge opening 12 formed between the first and second roof planes, 14 and 16, and allows a flow of exhaust air to travel through an attic and exit through the ridge vent 10. The flow of the exhaust air is shown by the arrows A.

Figure 3:
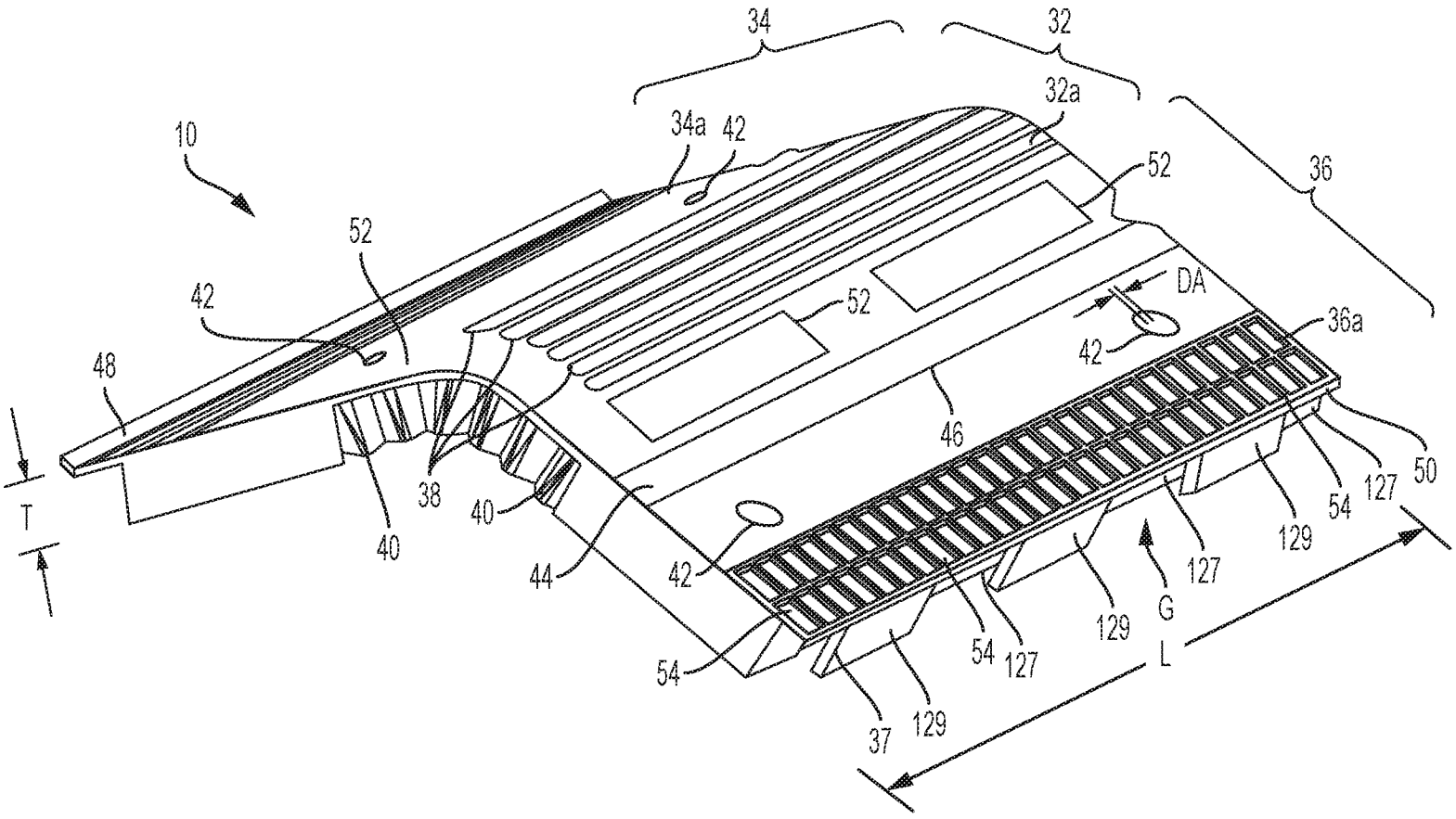
FIG. 3 is a partial perspective view of the rollable ridge vent of FIG. 1A illustrated in a flexed position.

Referring now to FIG. 3, the ridge vent 10 is shown in a flexed position. The rollable ridge vent 10 has a length L and a thickness T. In the illustrated embodiment, the length L greater than four feet and the thickness is approximately 1.0 inches. For example, the rollable ridge vent may be provided on any length roll. For example, the length L may be 20-50 feet long, such as 20 feet long, 25 feet long, 30 feet long, 35 feet long, 40 feet long, 45 feet long, or 50 feet long. Alternatively, the length L of the ridge vent 10 can be more or less than 20-50 feet and the thickness T can be more or less than approximately 1.0 inches.

The center portion 32 includes a plurality of optional grooves 38. Generally, the grooves 38 are configured to provide sufficient flexibility to the center portion 32 to allow the ridge vent 10 to flex in a direction generally perpendicular to the length L of the ridge vent 10, while also providing structural reinforcement to the center portion 32. The combination of flexibility and structural reinforcement provided by the grooves 38 allows a controlled curvature of the ridge vent 10 as the ridge vent 10 is flexed. The controlled curvature provides the flexed ridge vent 10 with a smooth curvature when installed on a roof. However, configuring the ridge vent 10 to include the grooves 38 is optional and not necessary for the use of the ridge vent 10.

As shown in FIG. 3, the grooves 38 are oriented to extend in a direction generally parallel to each other and parallel to the edges, 35 and 37. Alternatively, the grooves 38 can have other orientations sufficient to allow the ridge vent 10 to flex in a direction generally perpendicular to the length L of the ridge vent 10, while also providing structural reinforcement to the center portion 32. The grooves will be discussed in more detail below.

Figure 6:
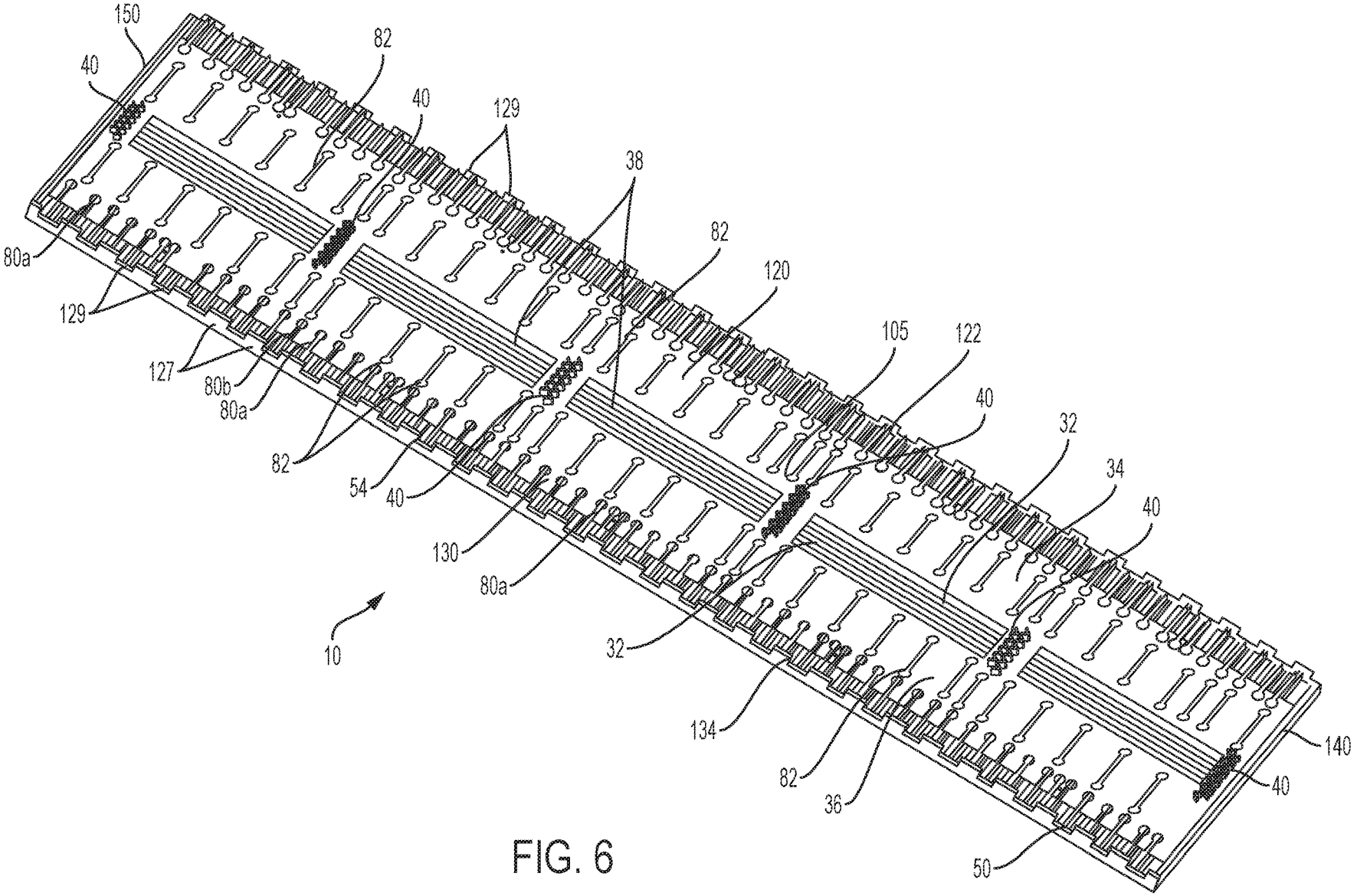
FIG. 6 is a bottom perspective view of the rollable ridge vent of FIG. 4.
Figure 7B:
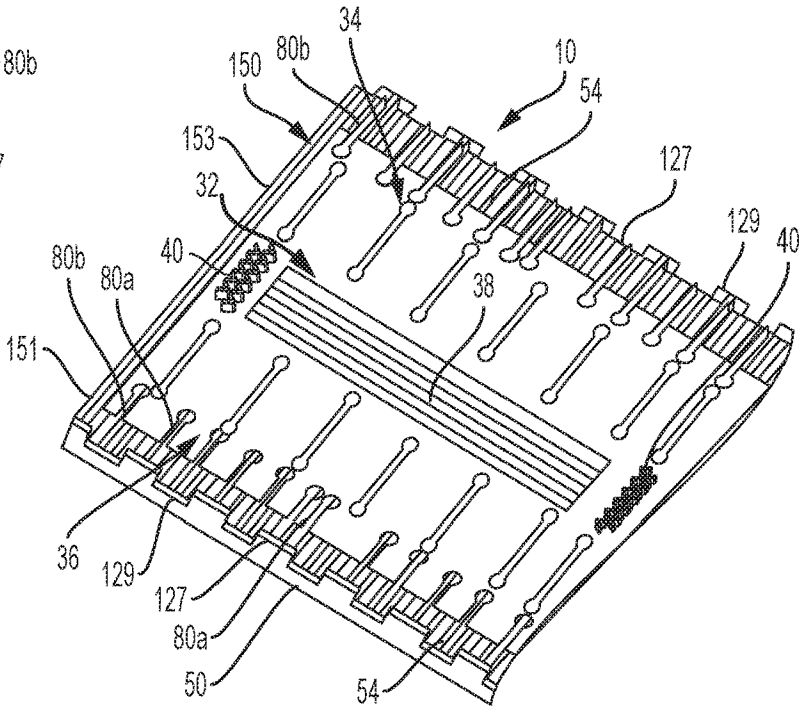
FIGS. 7A-7B include a bottom perspective view of two vent portions of FIG. 1A, illustrating mating of the end connections of two vent portion.
Figure 7A:
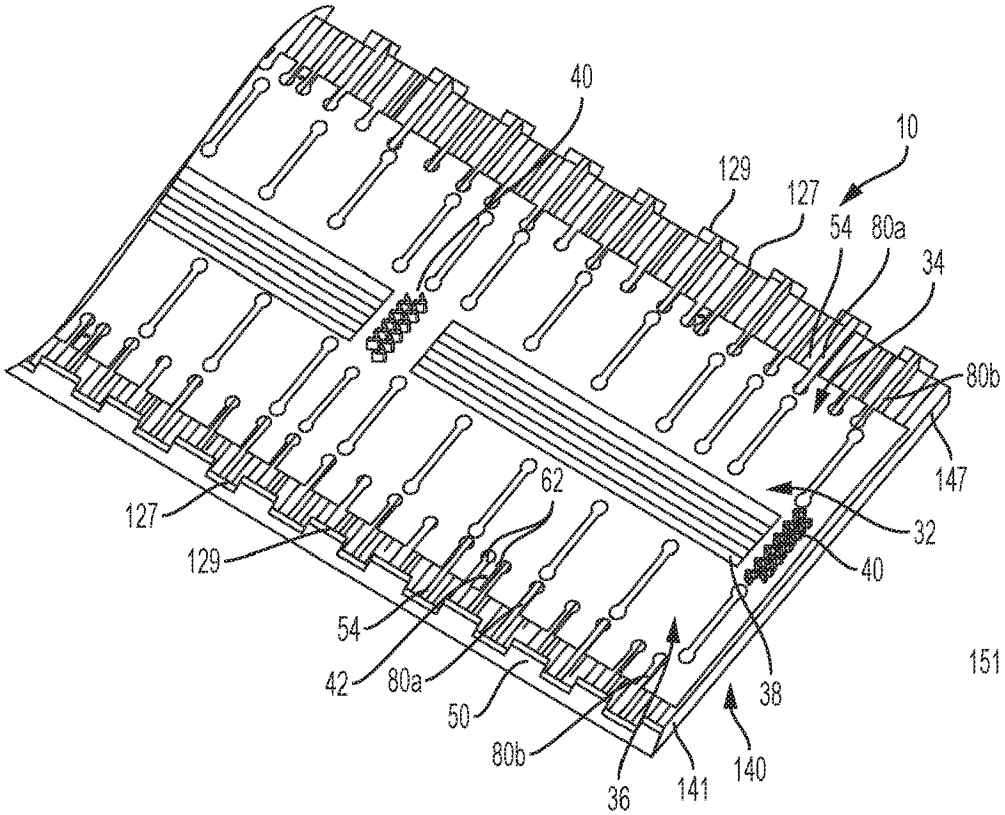

As shown in FIGS. 3 and 6, the center portion 32 of the ridge vent 10 includes a plurality of projections 40 extending downward from the center portion 32. Groups of the projections 40 extend downward from the central portion 32 of the panel, between the groups of grooves 38 and at the longitudinal ends of the panel. The groups of projections provide spacing away from the roof deck and reinforcement for the central portion, while permitting lateral bending of the central portion of the panel. The plurality of projections 40 are configured to nest against each other as the center portion 32 of the ridge vent 10 is flexed, thereby substantially sealing the end of the center portion 32 of the ridge vent 10. The projections 40 will be discussed in more detail below.

Referring again to FIG. 3, the left and right portions, 34 and 36, have optional fastening apertures 42. The fastening apertures 42 may be replaced with fastener detents or dimples or may be omitted completely. The fastening apertures 42 are spaced apart along the length L of the ridge vent 10. In one embodiment, the fastener is a roofing nail. In other embodiments, the fastener can be other desired devices, including, but not limited to flat-headed screws.

As shown in FIG. 3, the left and right portions, 34 and 36, each have an optional nail line 44 (for purposes of clarity, only the nail line 44 on right portion 36 is shown). The nail line 44 extends along the length L of the ridge vent 10 and generally parallel to the edge 37. The nail line 44 is configured to provide locations in which the installer can nail ridge vent shingles 30 to the ridge vent 10. The installation of the ridge vent 10 and ridge vent shingles 30 will be discussed in more detail below. In the illustrated embodiment, the nail line 44 includes a plurality of images 46. The images 46 include suggested nail insertion positions and instructions to the installer for installing ridge vent shingles over the ridge vent 10. Alternatively, the nail line 44 can be void of any images or the nail line 44 can include any desired images.

Referring again to FIG. 3, the ridge vent 10 includes a left wing 48 and a right wing 50. The left wing 48 is positioned on the top surface 34*a* of the left portion 34 at the left edge 35. Similarly, the right wing 50 is positioned on the top surface 36*a* of the right portion 36 at the right edge 50. In the illustrated embodiment, the wings, 48 and 50, extend along the length L of the ridge vent 10. Alternatively, the wings, 48 and 50, can extend a desired distance that is shorter than the length L of the ridge vent 10. Generally, the wings, 48 and 50, are configured to assist in the flow of air through the ridge vent 10. The flow of air through the ridge vent 10 will be discussed in more detail below.

As shown in FIG. 3, optionally the ridge vent 10 includes indicia 52 positioned on the top surfaces, 32*a*, 34*a* and 36*a* of the ridge vent 10. For purposes of clarity, the indicia 52 is only shown on the right portion 36 and at one end of the center portion 32. The indicia 52 can include a variety of desired messages, including, but not limited to product and company logos, promotional messages, installation instructions and product features. However, configuring the ridge vent 10 to include indicia 52 is optional and not necessary for the use of the ridge vent 10.

Referring again to FIG. 3, the ridge vent 10 includes a plurality of louvers 54. In operation, the flow of air through the ridge vent 10 exits through the louvers 54. In the embodiment illustrated by FIGS. 1A, 2A, and 3, the louvers 54 are arranged in a column and row configuration having a quantity of two columns and rows extending substantially along the length L of the ridge vent 10. In the example shown in FIG. 3, the louvers 54 are positioned such that an outward column is substantially adjacent an edge, 35 or 37. In the embodiment illustrated by FIGS. 4-11, the louvers 54 are arranged in a single row configuration having different sized openings that correspond to the positions of staggered inner walls 127 and outer walls 129. The openings that end at the inner walls 127 are shorter than the openings that open at the outer walls 129. In other embodiments, the louvers 54 can be arranged in other desired configurations. In other embodiments, the louvers 54 can be positioned in other desired locations sufficient to allow the flow of air to exit the ridge vent 10 through the louvers 54. In the illustrated embodiments, the louvers 54 have a square shape. In other embodiments, the louvers 54 can have other shapes, including, but not limited to round or hexagonal shapes sufficient to allow the flow of air to exit the ridge vent 10 through the louvers 54.

Figure 4:
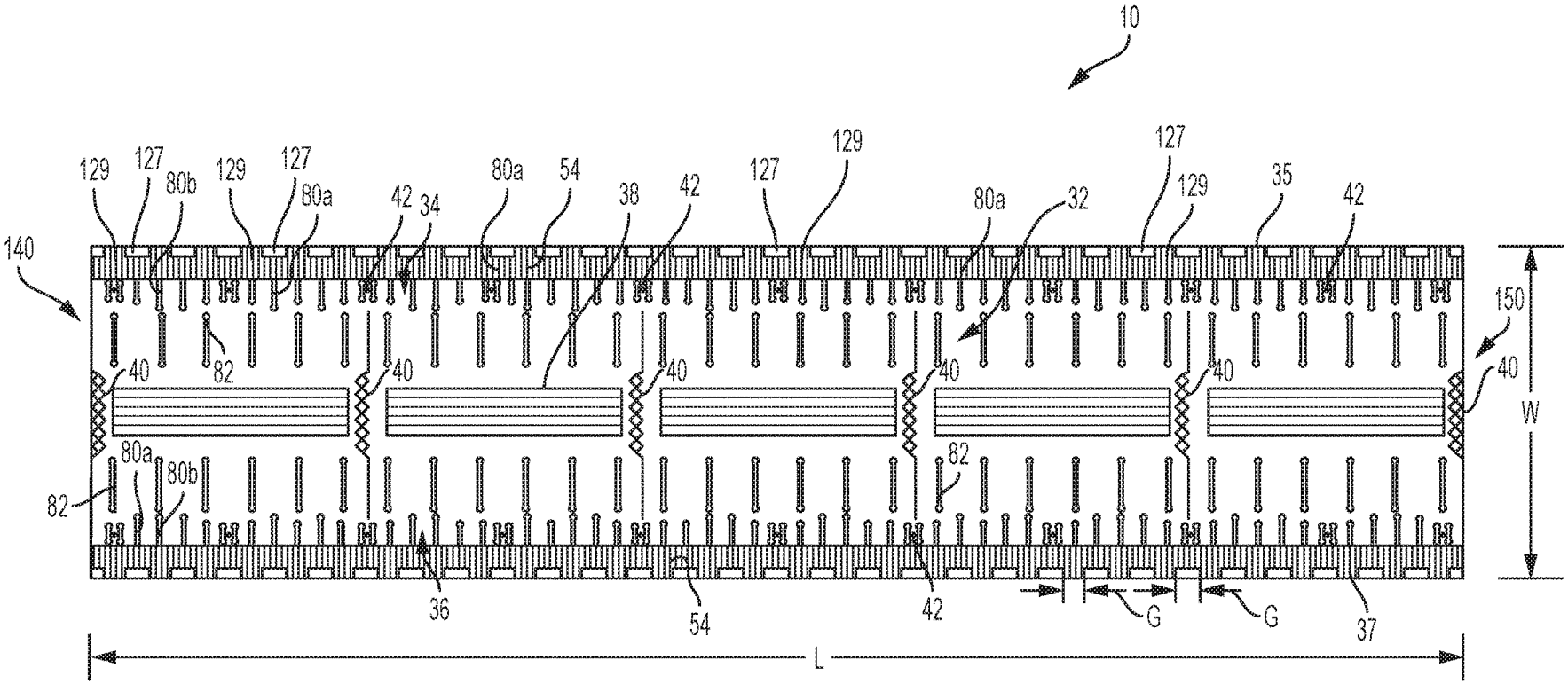
FIG. 4 is an elevational view of the bottom of an exemplary embodiment a rollable ridge vent with end connections.

Referring now to FIG. 4, the rollable ridge vents 10 have an un-flexed width W extending from the left edge 35 to the right edge 37. In the illustrated embodiment, the width W is approximately 12-16 inches. Alternatively, the width W can be more or less than approximately 12-16 inches. As shown in FIG. 4, the bottom surface 32*b* of the center portion 32, the bottom surface 34*b* of the left portion 34 and the bottom surface 36*b* of the right portion 36 are illustrated.

In the exemplary embodiment illustrated by FIG. 4, the center portion 32 of the ridge vent 10 includes space apart, repeating sets the grooves 38. The repeating sets of grooves 38 extend substantially the length L of the ridge vent 10. In the illustrated example, each set of grooves has a quantity of six grooves 38. Alternatively, the ridge vent 10 can have more or less than six grooves 38.

Figure 5:
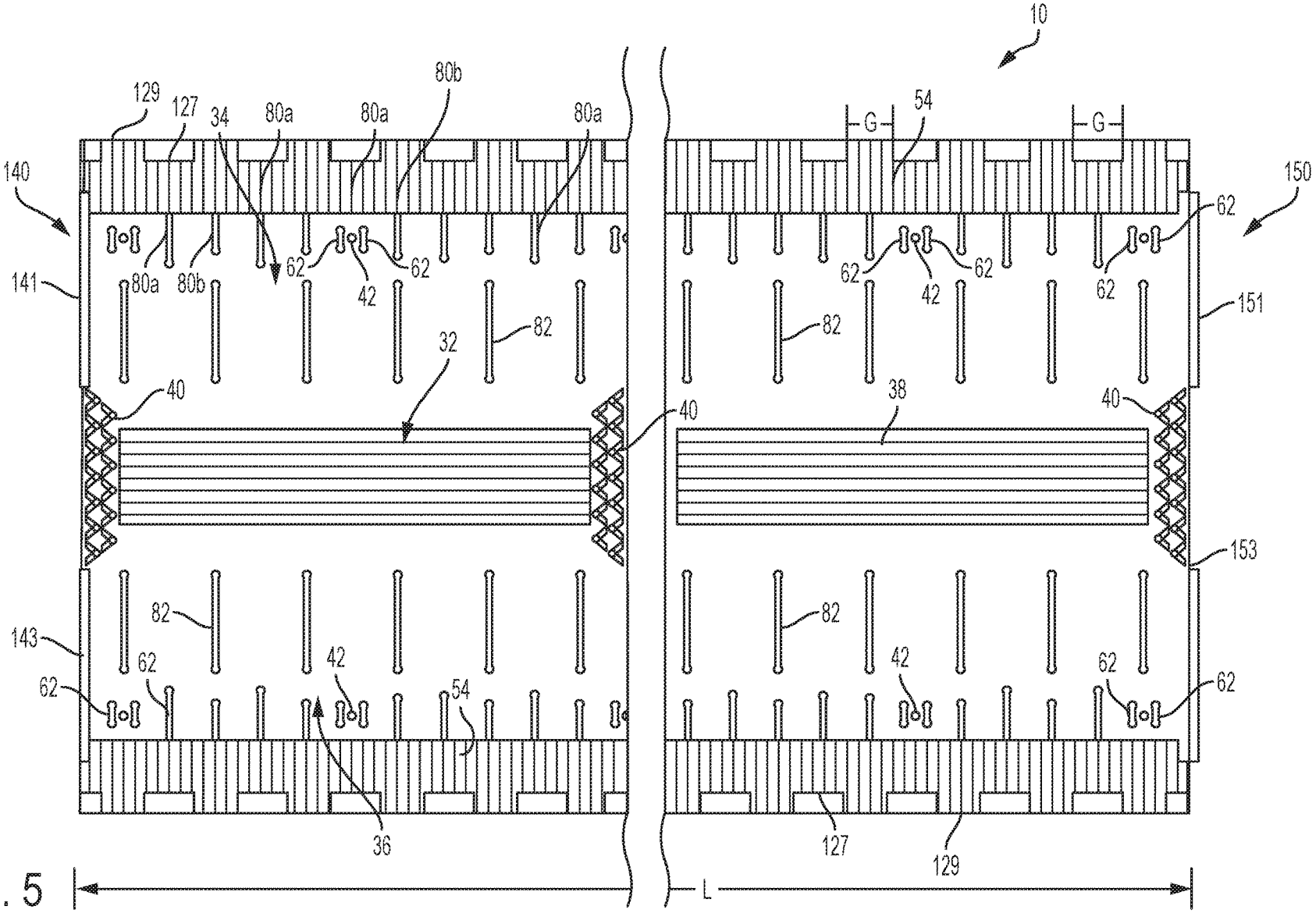
FIG. 5 is an enlarged, partial version of the view illustrated by FIG. 4.

As shown in FIGS. 4-6, the spaced apart sets of projections 40 extend from the bottom surface of the center portion 32. As discussed above, the plurality of projections 40 are configured to nest against each other as the center portion 32 of the ridge vent 10 is flexed, thereby forming a sealing structure for the end of the center portion 32 of the ridge vent 10. In the illustrated embodiment, the projections 40 have a cross sectional shape in the form of a "V" wherein the tip of the "V" points in a direction toward the grooves 38. In other embodiments, the projections can have other desired cross-sectional shapes and can be oriented in different directions sufficient to form a sealing structure by nesting against each other as the center portion 32 of the ridge vent 10 is flexed, thereby effectively sealing the end of the center portion 32 of the ridge vent. As shown in enlarged FIG. 7, the projections 40 have two legs that intersect to form the "V" shape of the projection 40. In the illustrated embodiment, the legs have a same length. In other embodiments, the length of the legs can be different. While the embodiment shown in FIGS. 4-7 illustrates the projections 40 as having a "V" shape, it is within the contemplation of this invention that the projections 40 could have other desired shapes, including, but not limited to a "U" shape or a "W" shape.

Still referring to FIGS. 4-7, the projections 40 are positioned in rows and arranged such that the projections 40 of the inner row are offset from the projections 40 of the outer row. For example, the projections of the inner row can be positioned half-way between the projections of the outer row. Alternatively, the projections 40 can be positioned in any desired quantity of rows and can be arranged in any desired configuration, sufficient to nest against each other as the center portion 32 of the ridge vent 10 is flexed, thereby effectively sealing the end of the center portion 32 of the ridge vent. While the embodiment shown in FIGS. 4-7 illustrates a quantity of seven projections 40 positioned in the outer row and a quantity of six projections 40 positioned in the inner row, it should be understood that any desired quantity of projections 40 can be used sufficient to nest against each other as the center portion 32 of the ridge vent 10 is flexed, thereby effectively sealing the end of the center portion 32 of the ridge vent.

Referring now to FIGS. 4 and 5 and as discussed above, the ridge vent 10 optionally has a plurality of fastening apertures, detents and/or dimples 42, positioned in the left and right portions, 34 and 36, and spaced apart along the length L of the ridge vent 10. As best shown in FIG. 5, the fastening apertures 42 are flanked by a plurality of support members or walls 62 to support the top surface of the vent 10 as fasteners, such as nails, are driven through the apertures, detents and/or dimples and into the roof deck. The illustrated support members 62 are short walls that extend from the top surface of the vent to the roof deck to support the top surface of the vent, thereby providing a solid support surface for seating the fastener. However, the support members can have any shape. For example, the support members 62 can be cylindrical bosses.

A staggered series of laterally inner and laterally outer side walls 127, 129 extend from the underside of the panel and laterally across the side portions. These inner and outer walls 127, 129, along with the other support structures of the vent, define a spacing between the top panel of the vent and the roof when the ridge vent unit is attached to the roof. The laterally inner side walls 127 are each joined with an inner reinforcing wall 80*a*. The laterally outer side walls 129 are each joined with an outer reinforcing wall 80*b*. The reinforcing walls 80*a*, 80*b* extend downward from the panel to further support the sides of the rollable ridge vent on the roof deck. The inner side walls 127 and the outer side walls 129 are staggered. The ends of the inner side walls 127 and the ends of the outer side walls 129 are spaced apart by gaps G The staggering and the gaps G permit longitudinal bending or rolling of the ridge vent unit. In the illustrated embodiment, the gaps are nearly as long as the length of each inner side wall 127 and outer side wall 129, for example in one embodiment, (approximately 1 inch).

Referring again to FIGS. 4 and 5, the rollable ridge vent 10 also includes a plurality of interior baffles 82. The walls 80*a*, 80*b* and the baffles 82 extend in a direction that is generally perpendicular to either the direction of the length of the vent. The interior baffles 82 are positioned between the grooves 38 and the louvers 54. The interior baffles 82 are configured to provide structural support to the left and right portions, 34 and 36. The embodiment shown in FIGS. 4 and 5 illustrates the walls 80*a* and 80*b*, and baffles 82 as straight members that are oriented to be substantially perpendicular to the edges, 35 and 37. This configuration is conducive to rolling of the ridge vent.

Referring now to FIG. 3, the ridge vents 10 have a left wing 48 and a right wing 50. The wings 48, 50 extends in an upward and outward direction. Wind that encounters one of the left or right wings, 48 or 50 is deflected up and over the louvers 54, creating an area of relatively lower pressure above the louvers 54. The area of low pressure above the louvers 54 causes a lifting action thereby pulling air through the ridge vent 10 and out of the attic. Accordingly, the area of relatively lower pressure, caused by the wings, 48 and 50, facilitates the exit flow of attic air through the ridge vent 10.

Figure 8B:
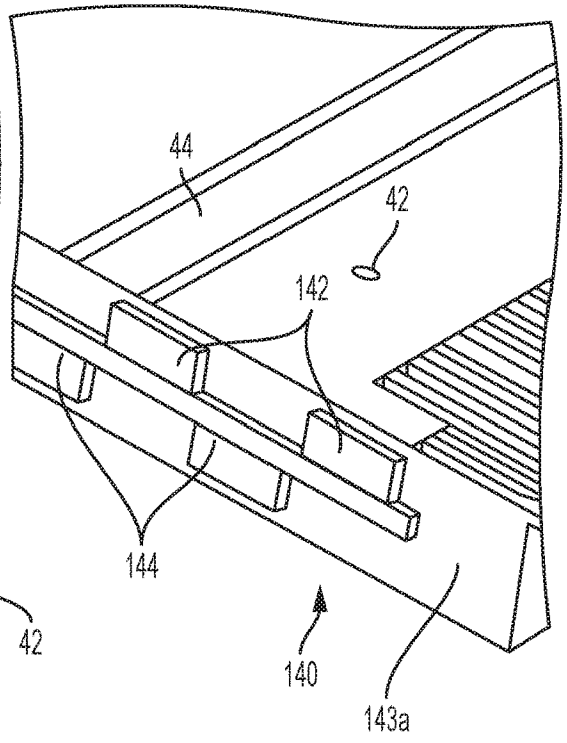
FIG. 8B is an enlarged portion of FIG. 8A.
Figure 8A:
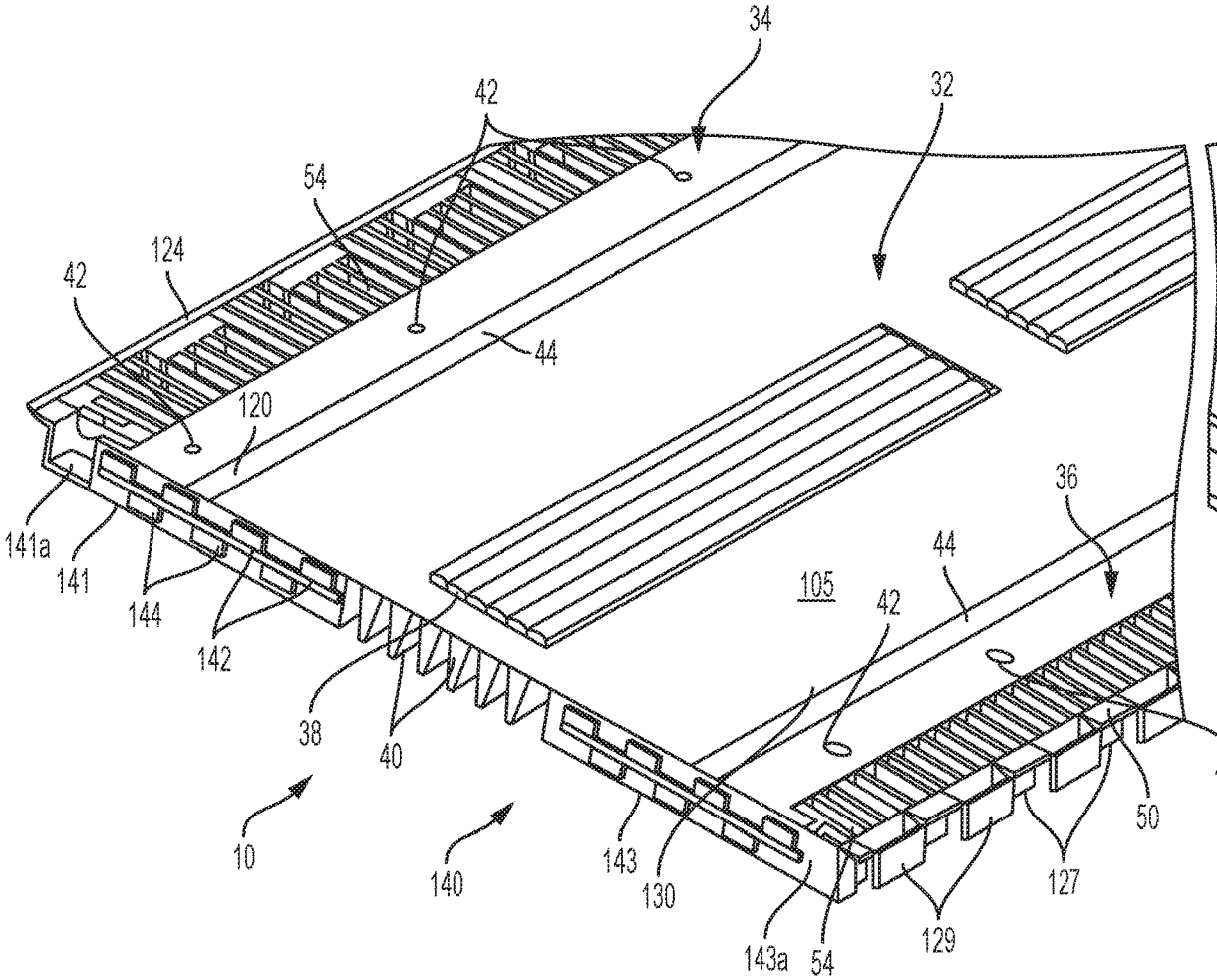
FIG. 8A is a top perspective view of a first end of the ridge vent illustrated by FIG. 4.
Figure 9B:
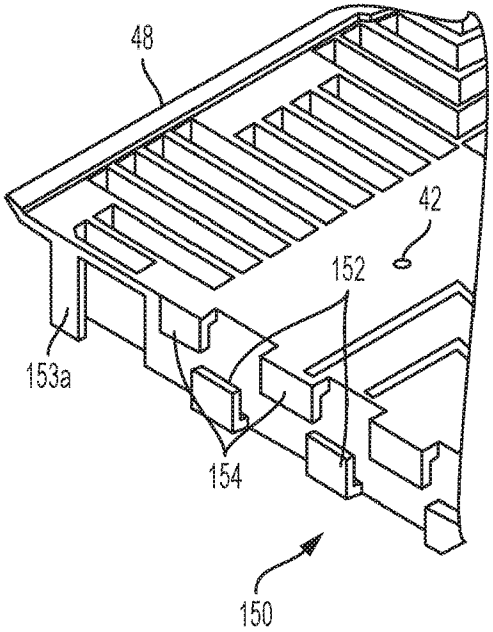
FIG. 9B is an enlarged portion of FIG. 9A.
Figure 9A:
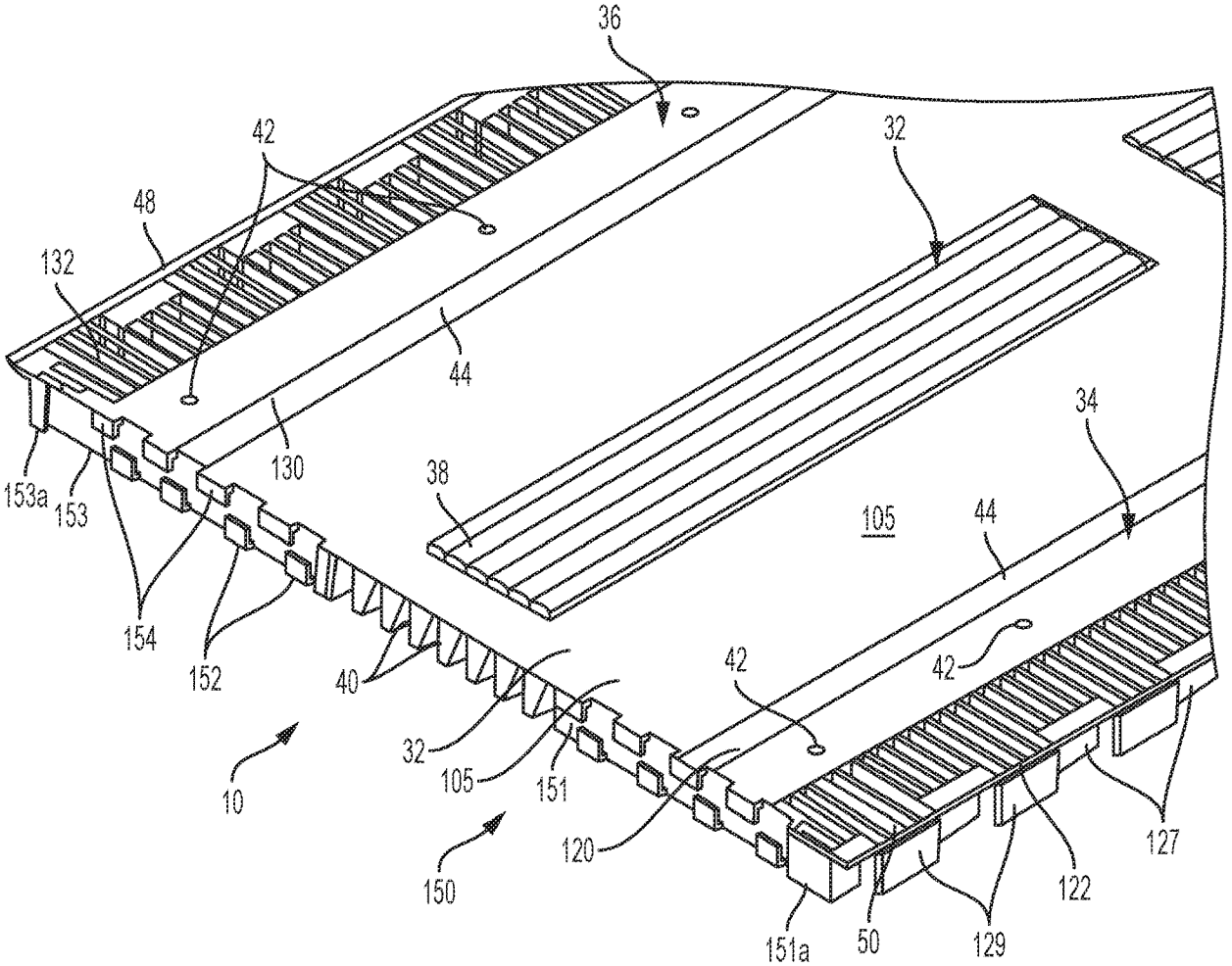
FIG. 9A is a top perspective view of a second end of the ridge vent illustrated by FIG. 4.
Figure 10B:
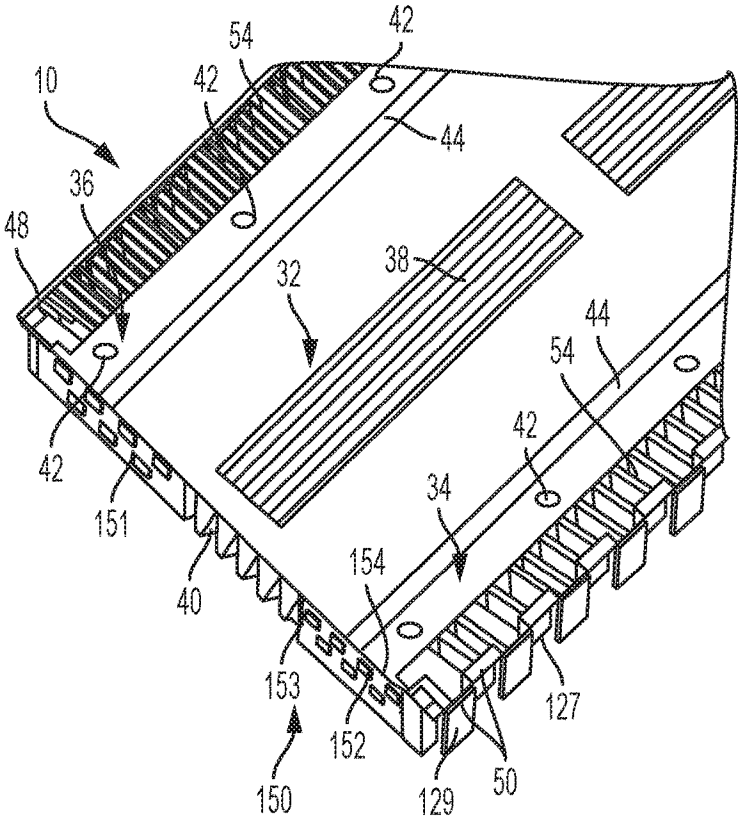
FIGS. 10A-10B include top perspective views of the two ends of the ridge vent illustrated by FIG. 4 to illustrate connection of vent sections together.
Figure 10A:
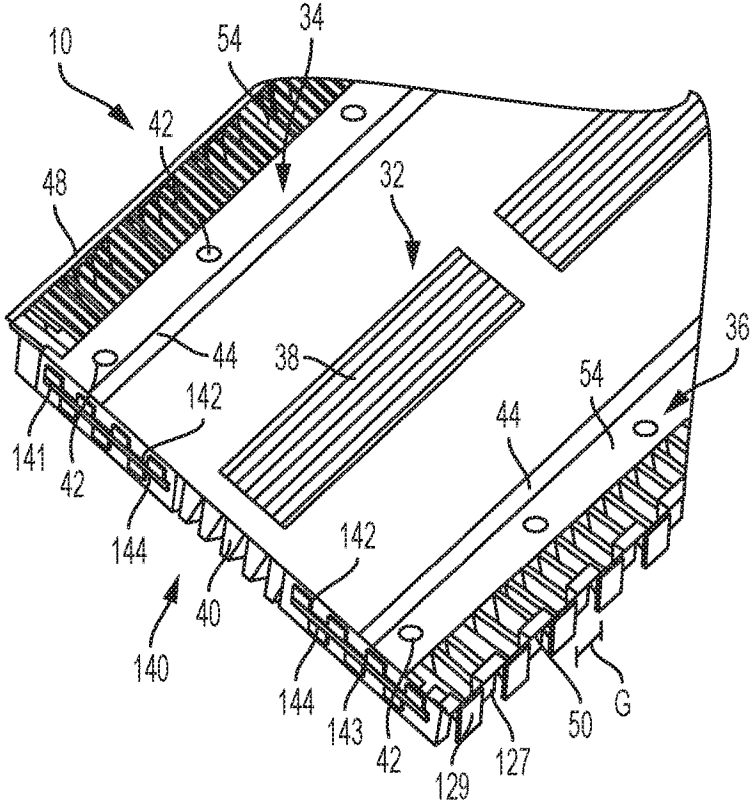
Figure 11A:
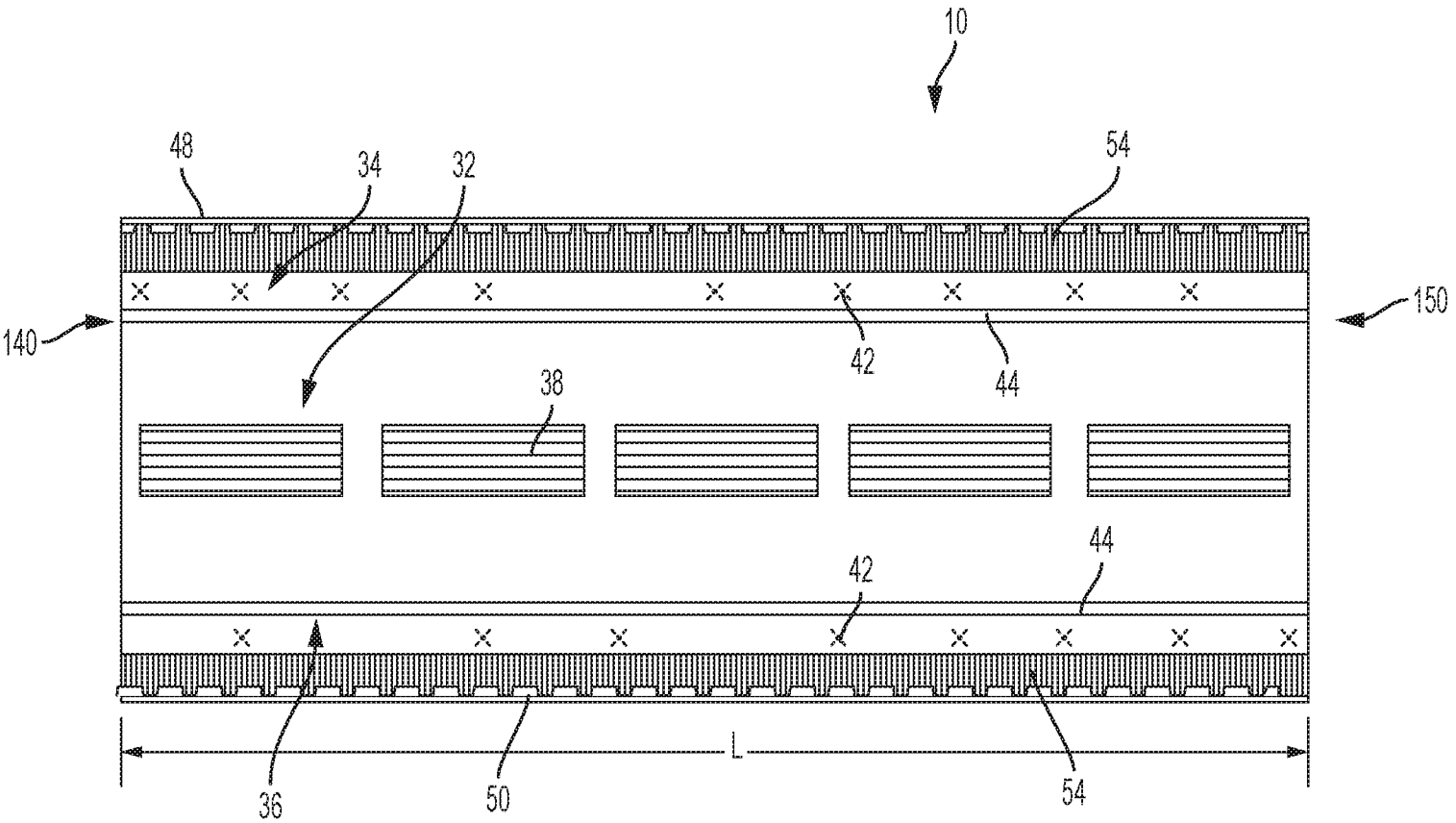
FIG. 11A is a top elevational view of the rollable ridge vent with end connections of FIG. 4.
Figure 11B:
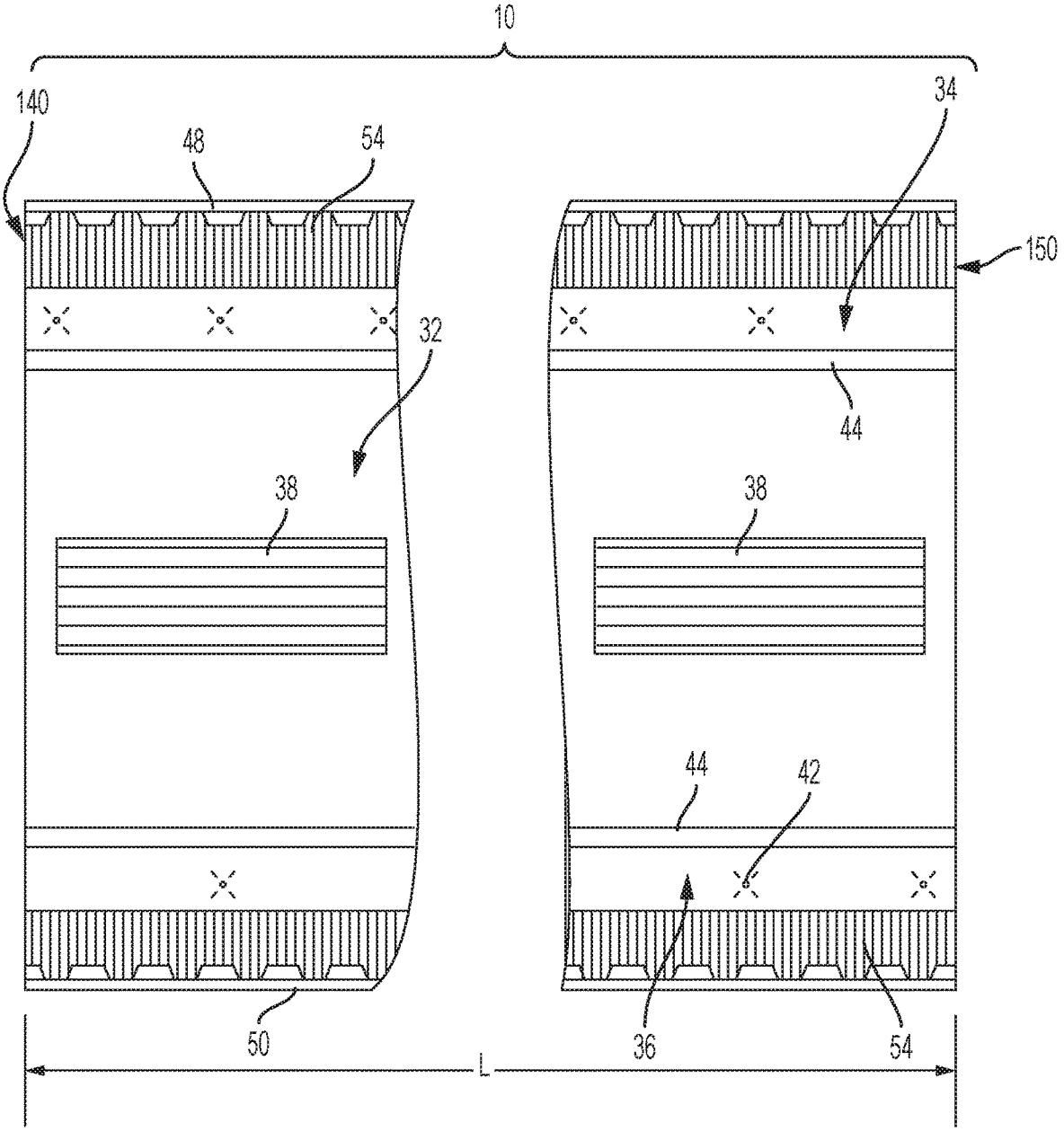
FIG. 11B is an enlarged, partial version of the view illustrated by FIG. 11A.

Referring to FIGS. 8A, 8B, 9A, and 9B, first and second end connecting portions 140, 150 include end walls 141, 143, 151, 153. The end walls 141, 143, 151, 153 are laterally outward of the V-shaped projections 40 and extend downward from the top panel. Referring to FIGS. 8A and 8B, alternating upward and downward extending insertion prongs 142, 144 extend from the first end walls 141, 143. Referring to FIGS. 9A and 9B, upward and downward extending receiver prongs 152, 154 extend from the second end walls 151, 153.

Ridge vents 10 may be mechanically attached to form long, rolled ridge vents and/or to form a long/unitary ridge vent on the ridge of the roof. To mechanically attach adjacent ridge vent units 10, the first end connecting portion 140 of a first ridge vent unit is brought into abutment with the second end connecting portion 150 of a second ridge vent unit, with the insertion prongs 142, 144 offset from the receiver prongs 152, 154 to permit abutment. The first and second end connecting portions 140, 150 are then laterally slid with respect to each other to interlockingly mesh the insertion prongs 142, 144 with the receiver prongs 152, 154 to connect the two ridge vent units together.

Figure 12A:
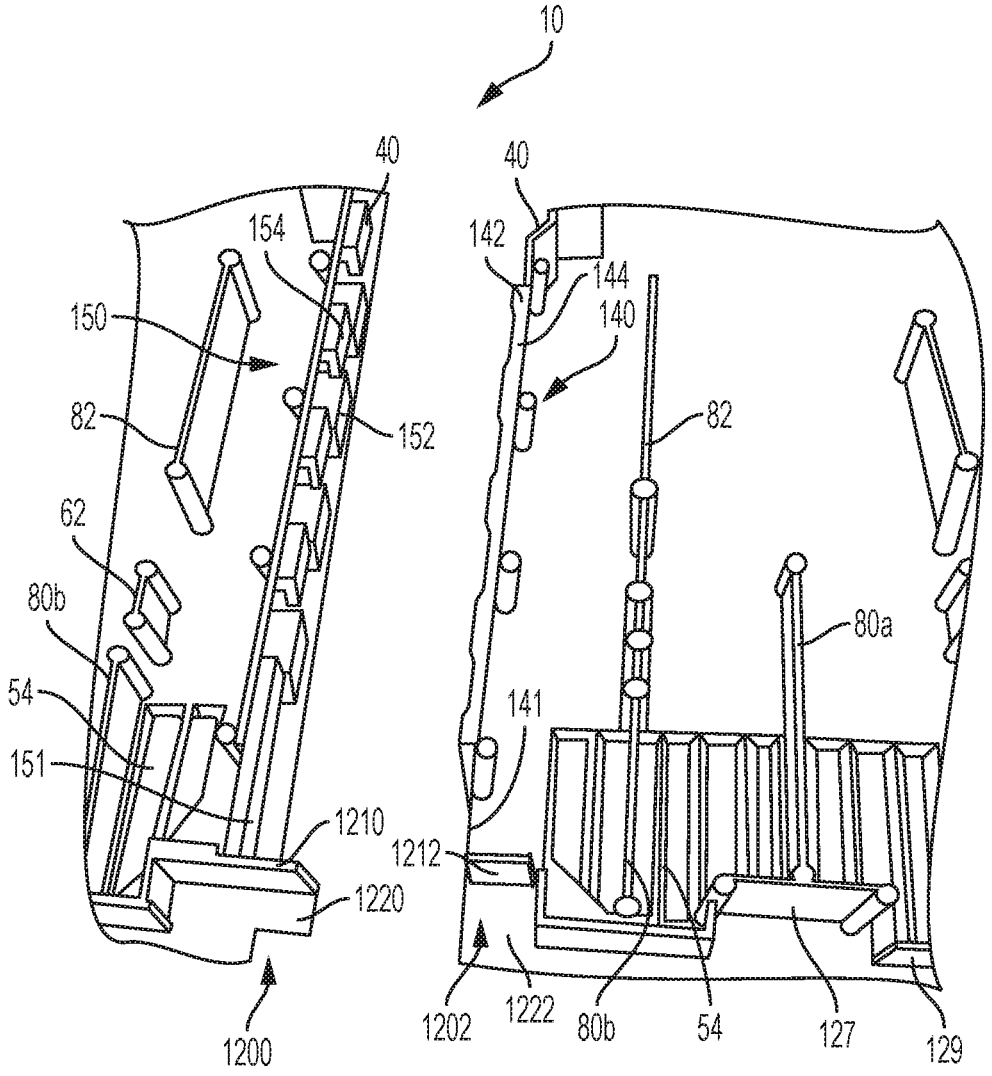
FIG. 12A is a partial perspective view of an exemplary embodiment of two ridge vents being connected together.
Figure 12B:
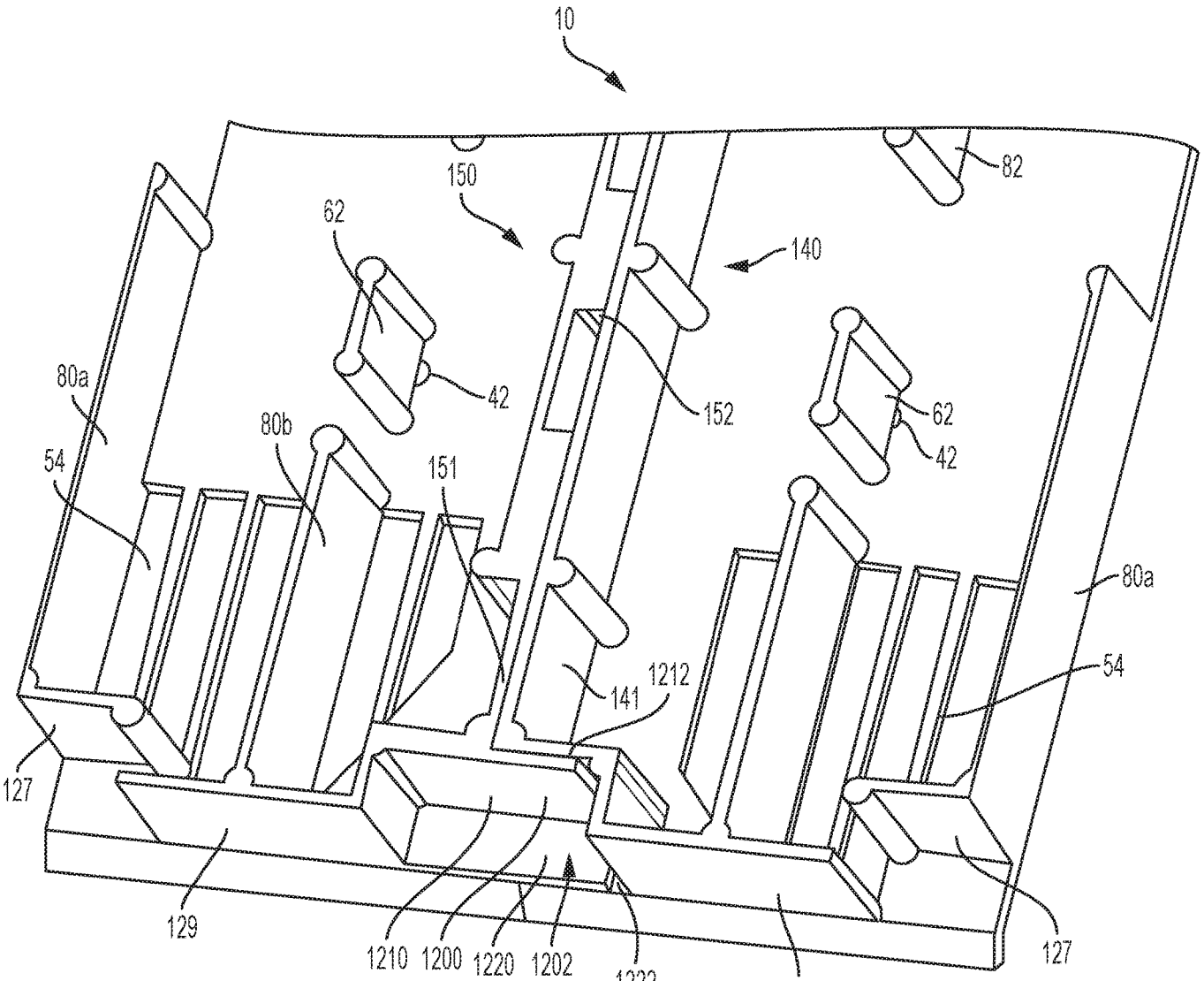
FIG. 12B is a partial perspective view of an exemplary embodiment of two ridge vents connected together.

Referring to FIGS. 8A, 8B, 9A, and 9B, the ridge vent units are optionally secured in the mechanically attached condition by welding. For example, outer portions 141*a*, 143*a*, of end walls 141, 143 (FIGS. 8A and 8B) can be welded to outer portions 151*a*, 153*a* of the end walls 151, 153 (FIGS. 9A and 9B), which prevents lateral sliding of the interlocking prongs toward disengagement. However, the ridge vents 10 may be welded together in a wide variety of different ways. For example, FIGS. 12A and 12B illustrate an exemplary embodiment where the vent includes a tab 1200 and a recess 1202. A surface of the tab 1200 is welded to a surface that forms the recess to secure the relative positions of the vents. For example, wall 1210 can be welded to wall 1212 and/or wall 1220 can be welded to wall 1222 to secure the vents together.

Any number of vents can be connected and/or welded together to form a rolled ridge vent having a wide variety of different lengths. For example, a series of six, five foot long ridge vent units are connected and welded together to form a thirty foot long ridge vent assembly.

Referring now to FIGS. 1A, 2A, and 3, the ridge vent 10 is installed over the ridge opening 12 in the following steps. First, a first ridge vent 10 is flexed thereby forming ridge vent angle β between the left and right portions, 34 and 36. The ridge vent 10 is flexed until the ridge vent angle β is the same as the slope angle α formed by the opposing rafters 18. Next, the flexed ridge vent 10 is positioned over the ridge opening 12 and fastened to the first and second roof planes, 14 and 16. The flexed ridge vent 10 is fastened to the roof planes, 14 and 16, as discussed above. Subsequent ridge vents 10 are flexed in a similar manner and connected to the installed ridge vent until the ridge opening 12 is completely covered. Finally as shown in FIG. 1, a course of ridge vent shingles 30 is installed, in an overlapping manner, over the installed ridge vents 10. In the illustrated embodiment, the ridge vent shingles 30 are installed over the ridge vents 10 using the nail lines 44 as nailing guides. Alternatively, other desired methods, including, but not limited to staples and adhesives, can be used to install the ridge vent shingles 30 over the ridge vents 10.

As discussed above, the ridge vent 10 is configured for several functions, including spanning a ridge opening 12 and allowing a flow of air to travel through an attic and exit through the ridge vent 10. These functions are performed in an outdoor environment, with all of the elements of the weather. Accordingly, the ridge vent 10 is made of a material sufficient to provide both structural and weatherability features. In the illustrated embodiment, the ridge vent 10 is made of a polypropylene material. Alternatively, the ridge vent 10 can be made of other polymeric materials sufficient to provide both structural and weatherability features. In other embodiments, the ridge vent 10 can be made of other desired materials or a combination of desired materials.

The principle and mode of operation of exemplary embodiments of rollable ridge vents are described herein. However, it should be noted that the rollable ridge vent may be practiced otherwise than as specifically illustrated and described without departing from its scope.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Still further, while specifically shaped features have been shown and described herein, other geometries can be used including elliptical, polygonal (e.g., square, rectangular, triangular, hexagonal, etc.) and other shapes can also be used. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A rollable ridge vent configured to cover an open ridge of a roof and allow a flow of air to exit from the open ridge through the ridge vent, the ridge vent comprising:

a top panel having a center portion, a left side portion, and a right side portion, wherein the top panel includes a plurality of louvers for allowing the flow of air to exit the ridge vent;

a spaced apart series of left side inner walls extending downward from the left side portion of the top panel, each left side inner wall extending from a first end to a second end;

a spaced apart series of left side outer walls extending downward from the left side portion of the top panel, each left side outer wall extending from a first end to a second end;

a plurality of left side connecting walls extending downward from the left side portion, each left side connecting wall connecting the first end of one of the left side inner walls to the second end of one of the left side outer walls;

wherein the spaced apart series of left side inner walls and the spaced apart series of left side outer walls of the left side portion are staggered such that the left side inner walls do not overlap the left side outer walls;

a spaced apart series of right side inner walls extending downward from the right side portion of the top panel, each right side inner wall extending from a first end to a second end;

a spaced apart series of right side outer walls extending downward from the right side portion of the top panel, each right side outer wall extending from a first end to a second end;

a plurality of right side connecting walls extending downward from the right side portion, each right side connecting wall connecting the first end of one of the right side inner walls to the second end of one of the right side outer walls;

wherein the spaced apart series of right side inner walls and the spaced apart series of right side outer walls of the right side portion are staggered such that the right side inner walls do not overlap the right side outer walls.

2. The rollable ridge vent of claim 1, in which the left side portion has a left edge and the right side portion has a right edge, wherein the left edge has a left wing and the right edge has a right wing, wherein the left and right wings are configured to assist in the flow of air through the ridge vent.

3. The rollable ridge vent of claim 1, in which the left side portion has a left edge and the right side portion has a right edge, wherein left side outer walls of the left side portion extend downward from the left edge and the right side outer walls of the right side portion extend downward from the right edge.

4. The rollable ridge vent of claim 2, in which the left wing extends beyond a profile created by an intersection of the left side portion and the left side outer walls of the left side portion and the right wing extends beyond a profile created by an intersection of the right side portion and the right side outer walls of the right side portion.

5. A rollable ridge vent configured to cover an open ridge of a roof and allow a flow of air to exit from the open ridge through the ridge vent, the ridge vent comprising:

a top panel;

a first end wall extending downward from the top panel;

a second end wall extending downward from the top panel;

upward extending insertion prongs extending from a middle portion of the first end wall and spaced apart from the first end wall to form an upward facing insertion gap between the upward extending insertion prongs and the first end wall;

downward extending insertion prongs extending from the middle portion of the first end wall and spaced apart from the first end wall to form a downward facing insertion gap between the downward extending insertion prongs and the first end wall;

upward extending receiver prongs extending from a bottom portion of the second end wall and spaced apart from the second end wall to form an upward facing receiver gap between the upward extending receiver prongs and the second end wall;

downward extending receiver prongs extending from a top portion of the second end wall and spaced apart from the second end wall to form a downward facing receiver gap between the receiver prongs and the second end wall; and a plurality of louvers for allowing the flow of air to exit the ridge vent.

6. The rollable ridge vent of claim 5, wherein the insertion prongs and the receiver prongs are configured such that offsetting the insertion prongs with respect to receiver prongs of a second ridge vent allows the insertion prongs to be inserted into the receiver gaps of the receiver prongs of the second ridge vent, and laterally sliding the insertion prongs with respect to the receiver prongs of the second ridge vent interlockingly meshes the insertion prongs with the receiver gaps of the receiver prongs of the second ridge vent.

7. A rollable ridge vent assembly configured to cover an open ridge of a roof and allow a flow of air to exit from the open ridge through the ridge vent assembly, the ridge vent assembly comprising:

a first ridge vent member having:

a top panel;

a first end wall extending downward from the top panel;

a second end wall extending downward from the top panel;

upward extending insertion prongs extending from a middle portion of the first end wall and spaced apart from the first end wall to form an upward facing insertion gap between the upward extending insertion prongs and the first end wall;

downward extending insertion prongs extending from the middle portion of the first end wall and spaced apart from the first end wall to form a downward facing insertion gap between the downward extending insertion prongs and the first end wall; and a plurality of louvers for allowing the flow of air to exit the ridge vent assembly;

a second ridge vent member having:

a top panel;

a first end wall extending downward from the top panel;

a second end wall extending downward from the top panel;

upward extending receiver prongs extending from a bottom portion of the second end wall and spaced apart from the second end wall to form an upward facing receiver gap between the upward extending receiver prongs and the second end wall;

downward extending receiver prongs extending from a top portion of the second end wall and spaced apart from the second end wall to form a downward facing receiver gap between the receiver prongs and the second end wall; and a plurality of louvers for allowing the flow of air to exit the ridge vent assembly;

wherein when the first ridge vent member is connected to the second ridge vent member:

the upward extending insertion prongs of the first ridge vent member are inserted into the downward facing receiver gaps of the downward extending receiver prongs of the second ridge vent member;

the downward extending insertion prongs of the first ridge vent member are inserted into the upward facing receiver gaps of the upward extending receiver prongs of the second ridge vent member;

the upward extending receiver prongs of the second ridge vent member are inserted into the downward facing insertion gaps of the downward extending insertion prongs of the first ridge vent member; and the downward extending receiver prongs of the second ridge vent member are inserted into the upward facing insertion gaps of the insertion prongs of the first ridge vent member.

8. The rollable ridge vent of claim 7, wherein the first ridge vent member is welded to the second vent member.

9. A rollable ridge vent configured to cover an open ridge of a roof and allow a flow of air to exit from the open ridge through the ridge vent, the ridge vent comprising:

a top panel having a center portion, a left side portion, and a right side portion, wherein the top panel includes a plurality of louvers for allowing the flow of air to exit the ridge vent;

a spaced apart series of left side inner walls extending downward from the left side portion of the top panel, each left side inner wall extending from a first end to a second end;

a spaced apart series of left side outer walls extending downward from the left side portion of the top panel, each left side outer wall extending from a first end to a second end;

a plurality of left side connecting walls extending downward from the left side portion, each left side connecting wall connecting the first end of one of the left side inner walls to the second end of one of the left side outer walls;

wherein the spaced apart series of left side inner walls and the spaced apart series of left side outer walls of the left side portion are staggered such that the left side inner walls do not overlap the left side outer walls;

a spaced apart series of right side inner walls extending downward from the right side portion of the top panel, each right side inner wall extending from a first end to a second end;

a spaced apart series of right side outer walls extending downward from the right side portion of the top panel, each right side outer wall extending from a first end to a second end;

a plurality of right side connecting walls extending downward from the right side portion, each right side connecting wall connecting the first end of one of the right side inner walls to the second end of one of the right side outer walls;

wherein the spaced apart series of right side inner walls and the spaced apart series of right side outer walls of the right side portion are staggered such that the right side inner walls do not overlap the right side outer walls;

a first end wall extending downward from the top panel;

a second end wall extending downward from the top panel;

upward and downward extending insertion prongs extending from a middle portion of the first end wall;

upward and downward extending receiver prongs extending from bottom and top portions of the second end wall, respectively.

* * * * *